United States Patent [19]

Belton

[11] Patent Number: 4,569,665

[45] Date of Patent: Feb. 11, 1986

[54] PLAY BUILDING ELEMENT

[76] Inventor: Timothy Belton, 6 Hillcrest Pl., Sheridan, Wyo. 82801

[21] Appl. No.: 607,239

[22] Filed: May 4, 1984

[51] Int. Cl.[4] ..... A63H 33/08

[52] U.S. Cl. ..... 446/114; 446/125

[58] Field of Search ..... 446/114, 85, 87, 106, 446/108, 115, 120, 121, 122, 123, 124, 125, 116, 127

[56] References Cited

U.S. PATENT DOCUMENTS

| | | | |
|---|---|---|---|
| 1,163,851 | 12/1915 | Pringle | 446/127 X |
| 1,371,619 | 3/1921 | Greenstreet | 446/124 |
| 1,894,061 | 1/1933 | Sanders | 446/114 |
| 2,104,742 | 1/1938 | Fleischer | 446/106 |
| 2,633,662 | 4/1953 | Nelson | 446/114 |
| 2,691,242 | 10/1954 | Young | 446/115 |
| 2,786,301 | 3/1957 | Torricelli | 446/115 |
| 2,844,910 | 7/1958 | Korchak | 446/106 |
| 3,236,004 | 2/1966 | Christiansen | 446/120 X |
| 3,442,044 | 5/1969 | Quercetti | 446/124 |
| 3,537,706 | 11/1970 | Heavener | 446/85 X |
| 3,564,758 | 2/1971 | Willis | 446/114 X |
| 3,570,170 | 3/1971 | Kishi | 446/128 |
| 3,613,291 | 10/1971 | Howe | 446/124 X |

FOREIGN PATENT DOCUMENTS

| | | | |
|---|---|---|---|
| 2814192 | 4/1978 | Fed. Rep. of Germany | 446/124 |
| 436079 | 11/1967 | Switzerland | 446/114 |
| 16221 | of 1893 | United Kingdom | 446/114 |
| 2118447 | 11/1983 | United Kingdom | 446/124 |

*Primary Examiner*—Robert A. Hafer

*Assistant Examiner*—D. Neal Muir

*Attorney, Agent, or Firm*—Larson and Taylor

[57] ABSTRACT

A building element for use in constructing a play structure with similarly shaped elements is disclosed. The building element has a rectangular base provided with longitudinal slots in the center of each lateral side. Each slot extends inwardly by distance equal to one half of the distance from a respective corner of the base to an adjacent edge of a respective longitudinal slot. At least one lateral slot is also provided along each longitudinal side, the lateral slots are sized the same as the longitudinal slots and spaced from a respective corner or each other by the same distance which the lateral slots are spaced from a respective corner. A peripheral flange extends perpendicular from the back face of the base around the periphery of the back face and slots. The outer edge of the peripheral flange is spaced from the front face by a distance nominally equal to the width of the slots. A raised portion is also provided which extends perpendicularly from the back face of the base by the same distance as the peripheral flange and which includes a rest area which is spaced inwardly along the back face from each of the slots by a distance less than the length of each slot. Preferably, a longitudinal rib member and a lateral rib member extend between respective longitudinal slots and lateral slots. In addition, reinforcing ribs also extend between adjacent slots and the corners of the slots are reinforced. In the preferred embodiment, the building element is integrally formed of a foamed polyethylene or foamed polypropylene.

17 Claims, 8 Drawing Figures

PLAY BUILDING ELEMENT

FIELD OF THE INVENTION

The present invention relates generally to play building elements which can be assembled to build various structures, and more particularly to rectangular play building elements having slots along the edges whereby respective building elements are interlocked perpendicular to one another as respective slots are mutually received in one another.

BACKGROUND OF THE INVENTION

The use of play building elements which are interconnected to form play structures is well known in the art. For example, cylindrical, circular and square building elements have been sold in the United States under the name "Crystal Climbers". The square building elements included an inwardly directed rectangular slot in the center of each side which was somewhat wider than the thickness of the various elements so that a fair amount of play was provided when respective slots were mutually received in one another. Slots were also provided radially in the circular elements and axially in the cylindrical elements. These elements were made of a clear plastic material and were not of sufficient size, strength, or of a sufficiently tight connection to make structures which would support the weight of a child.

Various toy building elements have also been disclosed in a number of U.S. patents. For example, in U.S. Pat. No. 1,371,619 (Greenstreet), wooden toy building blocks are disclosed which include a square block having notches in the center of each side. In U.S. Pat. No. 1,163,851 (Pringle), a construction set including square and rectangular members with slots along the sides for interconnection is disclosed. The slots have a length so that a connecting board extends from the mid point of the rectangular member when two such members are perpendicularly connected with mating slots received in one another.

In U.S. Pat. No. 3,855,748 (Thomas), a playground assembly set including large and small rectangular members is disclosed. The large elements include a pair of slots along each edge while the smaller members have diagonal slots located at each corner. Another set of toy building elements is disclosed in U.S. Pat. No. 2,278,327 (Magnus et al). In this patent, a number of blocks which are rectangularly shaped and have slots along oposite edges are disclosed. The blocks interconnect with one another and are commonly made of wood although plastic, plywood, cardboard, or other suitable materials can be used. Similar shaped blocks are also disclosed in Swiss Pat. No. 436,079 (Kolliker-Koppel). Snap acting disc shaped elements are also disclosed in U.S. Pat. Nos. 2,984,935 (Beck) and 3,177,611 (Beck).

SUMMARY OF THE INVENTION

A building element for use in constructing a play structure with similarly shaped elements is provided. The building element includes a rectangular base having a front face, back face, two lateral sides, and two longitudinal sides. A rectangular longitudinal slot opening outwardly is provided in the center of each lateral side. Each longitudinal slot has a width equal to "W" and extends inwardly perpendicular from a respective lateral side by a distance "d" which is equal to one half of the lateral distance "D" from a respective corner of the base to the adjacent edge of a respective longitudinal slot. The base also includes a rectangular lateral slot opening outwardly along each longitudinal side. Each lateral slot is similarly sized to the longitudinal slots. A peripheral flange extends perpendicularly from the back face of the base around the periphery of back face and the slots. The peripheral flange has an outer edge which is spaced from the front face by a distance nominally equal to "W". The base is further provided with a raised portion which extends perpendicularly from the back face and which includes a rest area which is spaced inwardly along the back face from each of the longitudinal lateral slots by a distance less than "d". The rest areas of the raised portions have an outer edge which is spaced from the front face by a nominal distance "W". With this construction, the building element is interlocked with a similarly shaped perpendicular building element as respective slots on each element are mutually received in one another.

In the preferred embodiment, the lateral slots are located at the distace "D" from a respective adjacent corner of the base to the adjacent edge of a respective lateral slot. An additional lateral rectangular slot can also be provided along each longitudinal side adjacent the other respective corner of the base. If desired, additional intermediate rectangular slots sized and shaped the same as the lateral or longitudinal slots can also be provided at the distance "D" from a respective adjacent edge of an adjacent slot.

According to the preferred embodiment, the raised portion for the longitudinal slots is a flat longitudinal rib member extending between the longitudinal slots. This longitudinal rib member also serves to add rigidity to the building element. Preferably, the longitudinal rib member includes a pair of closely spaced, parallel ribs. It is also preferred that the raised portion for the lateral slots is a lateral rib member extending between opposed lateral slots. As with the longitudinal rib member, preferably the lateral rib member includes a pair of closely spaced, parallel ribs. Conveniently, the longitudinal rib member, the lateral rib member, the peripheral flange, and the base are integrally formed of a foamed polyethylene or foamed polypropylene.

In order to further reinforce the building element, the corners of the peripheral flange are provided with a greater thickness than the rest of the peripheral flange. In addition, reinforcing ribs which extend from an inside corner of a respective slot to the adjacent inside corner of an adjacent respective slot are also provided. These reinforcing ribs together form an additional longitudinal rib member.

It is an advantage of the present invention that a simply assembled, rugged, and structurally strong building element is provided. It is also an advantage of the present invention that structures constructed from such building elements have sufficient strength to support the weight of a child if desired.

Others features and advantages of the present invention are stated in or apparent from a detailed description of presently preferred embodiments of the invention found hereinbelow.

DETAILED DESCRIPTION OF THE PREFERRED EMBODIMENTS

Figure 1:
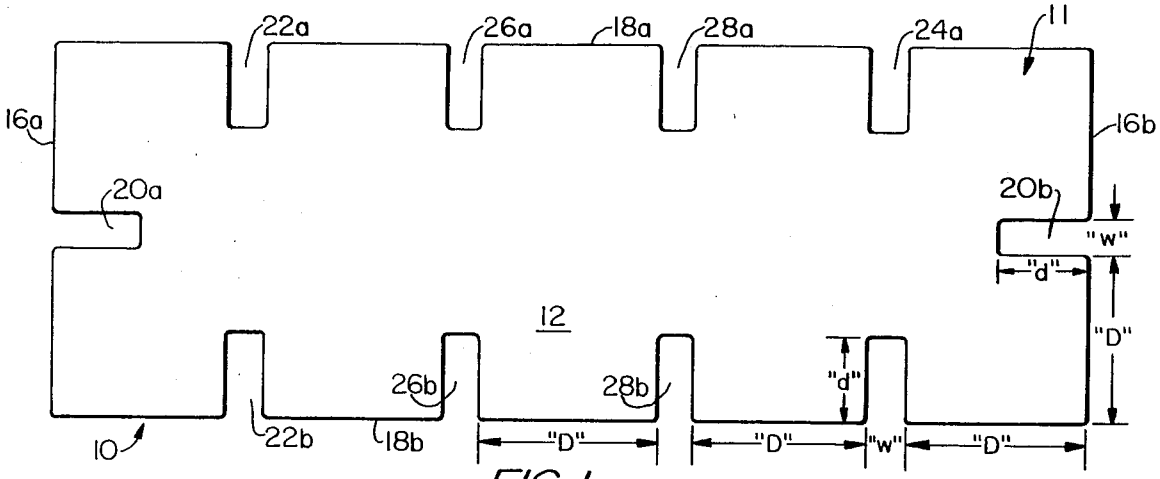
FIG. 1 is a top plan view of a first embodiment of a building element according to the present invention.
Figure 3:
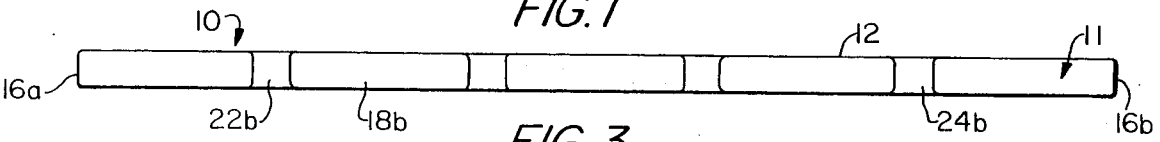
FIG. 3 is a front elevation view of the building element depicted in FIG. 1.

With reference now to the drawings in which like numerals represent like elements throughout the several views, a presently preferred embodiment of a building element 10 is depicted in FIGS. 1 to 5. Building element 10 includes a base 11 having a front face 12, a back face 14, lateral sides 16*a* and 16*b*, and longitudinal sides 18*a* and 18*b*. Located in the center of a respective lateral side 16*a* and 16*b* is a rectangular longitudinal slot 20*a* and 20*b*, respectively. Each longitudinal slot 20*a* and 20*b* has a width "W" and extends perpedicularly from respective lateral sides 16*a* and 16*b*. Longitudinal slots 20*a* and 20*b* have a length "d" which is equal to one half of the lateral distance "D" from a respective corner of base 11 to the adjacent edge of a respective longitudinal slot 20*a* or 20*b* as shown in FIG. 1.

Located adjacent the corners of base 11 along longitudinal sides 16*a* and 16*b* are lateral slots 22*a*, 22*b*, 24*a*, and 24*b*. As with longitudinal slots 20*a* and 20*b*, lateral slots 22*a*, 22*b*, 24*a*, and 24*b* also have a length equal to "d", a width equal to "W", and are spaced from an adjacent corner of base 11 by length "D". With this configuration, lateral slot 22*a* is directly opposite to lateral slot 22*b* and lateral slot 24*a* is directly opposite to lateral slot 24*b*.

In the embodiment of building element 10 depicted in FIG. 1, base 11 is also provided with intermediate slots 26*a*, 26*b*, 28*a*, and 28*b*. As with longitudinal slots 20 and lateral slots 22 and 24, intermediate slots 26 and 28 are similarly sized with a width equal to "W" and a length equal to "d". In addition, intermediate slots 26*a*, 26*b*, 28*a*, and 28*b* are spaced from each adjacent slot by the distance "D" as shown.

Figure 4:
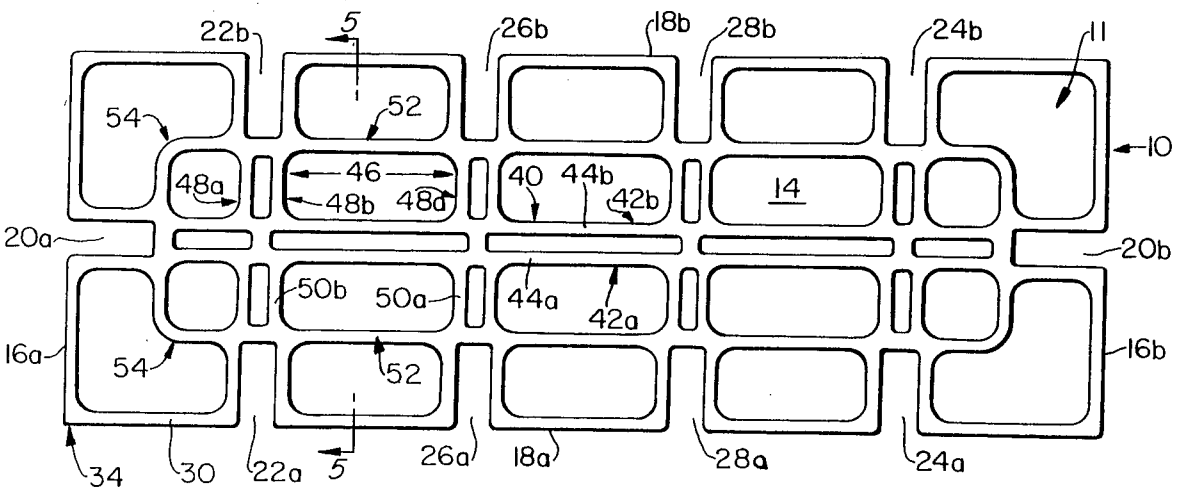
FIG. 4 is a bottom plan view of the building element depicted in FIG. 1.

As shown best in FIG. 4, a peripheral flange 30 extends from back face 14 around the perimeter of base 11 in which slots 20*a*, 20*b*, 22*a*, and 22*b*, 24*a*, 24*b*, 26*a*, 26*b*, 28*a*, and 28*b* are located. Peripheral flange 30 includes an outer edge 32 which is spaced from front face 12 by a distance nominally equal to "W". As shown for example in FIG. 4 at corner 34, peripheral flange 30 includes a small outside radius and a large inside radius. Thus, the thickness of peripheral flange 30 at corner 34 is greater than the adjacent portions of peripheral flange 30. In this manner, the corners of peripheral flange 30 such as corner 34 have a reinforced strength. Where the strength of the material forming peripheral flange 30 is sufficient, the reinforcement at the corners can be omitted.

Figure 5:
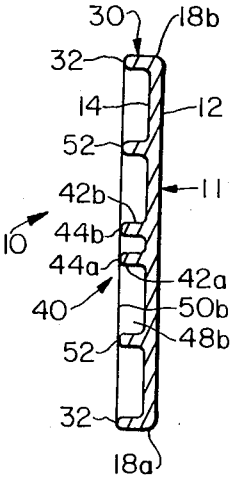
FIG. 5 is a cross-sectional side view taken along the line 5—5 in FIG. 4.
Figure 2:
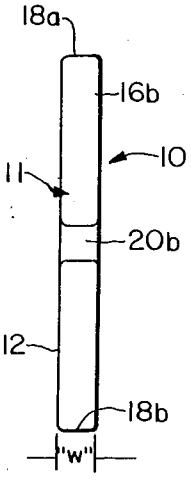
FIG. 2 is a right side view of the building element depicted in FIG. 1.

As also shown best in FIG. 4, a longitudinal rib member 40 extends between longitudinal slot 20*a* and longitudinal slot 20*b*. With reference also to FIG. 5, it can be seen that longitudinal rib member 40 includes two upstanding ribs 42*a* and 42*b* which are integrally formed with base 11. Ribs 42*a* and 42*b* have respective outer flat edges 44*a* and 44*b* which are spaced at the same nominal distance "W" from front face 12 of base 11. Longitudinal rib member 40 serves to reinforce building element 10 as well as cooperating with a similar building element to form a structure as will be explained subsequently.

As further shown in FIG. 4, building element 10 also includes a number of lateral rib members 46 extending between respective lateral slots 22*a*, 22*b*, 24*a*, and 24*b*, and between respective intermediate slots 26*a*, 26*b*, 28*a* and 28*b*. In a manner similar to longitudinal rib member 40, lateral rib members 46 include two parallel spaced ribs 48*a* and 48*b* having flat outer edges 50*a* and 50*b*, respectively. Ribs 48*a* and 48*b* are sized similar to ribs 42*a* and 42*b*, and extend away from front face 12 of base 11 by the same nominal distance "W" as edges 44*a* and 44*b* of ribs 42*a* and 42*b*. Lateral rib members 46 also serve to reinforce building element 10 and to cooperate with a similar building element when constructing a toy structure as explained subsequently.

Building element 10 also includes straight reinforcing ribs 52 such as straight rib 52 shown extending between lateral slot 22*b* and intermediate slot 26*b*. As shown best in FIG. 4, this straight reinforcing rib 52 begins at the lower corner of lateral slot 22*b* and is integrally formed with peripheral flange 30. This straight reinforcing rib 52 extends to the adjacent inner corner of intermediate slot 26*b*. It should be appreciated that the intersection of straight reinforcing ribs 52 with peripheral flange 30 and lateral rib members 46 has a reinforced thickness to strengthen the intersection area. Straight reinforcing ribs 52 extend away from front face 12 the same nominal distance "W" as peripheral flange 30.

At the corners of base 11, building element 10 also includes right angle reinforcing ribs 54 such as right angle reinforcing rib 54 depicted extending between longitudinal slot 20*a* and lateral slot 22*b*. As shown best in FIG. 4, this right angle reinforcing rib 54 extends from the bottom corner of a longitudinal slot 20*a* to the bottom corner of a lateral slot 22*b*. As with straight reinforcing rib 52, right angle reinforcing ribs 54 extend away from front face 12 by the nominal distance "W" and have reinforced areas where right angle reinforcing rib 54 join with peripheral flange 30, longitudinal rib member 40, and respective lateral rib members 46.

Conveniently, building element 10 is integrally formed of a foamed polyethylene or polypropylene which is also known as structural foamed polyethylene or structural foamed polypropylene. With such a material, all of the surfaces of building element 10 are relatively smooth and front face 12 is relatively flat. In addition, building element 10 is easily manufactured in a variety of colors and various surface textures.

It should be appreciated that building element 10 depicted in FIGS. 1 to 5 is illustrative of a variety of similar shaped building elements. As depicted in FIG. 1, building element 10 can have one or more of the intermediate portions removed to form a smaller, but similarly shaped building element. In addition, building elements with additional intermediate slots can be formed by similarly extending building element 10.

Figure 6:
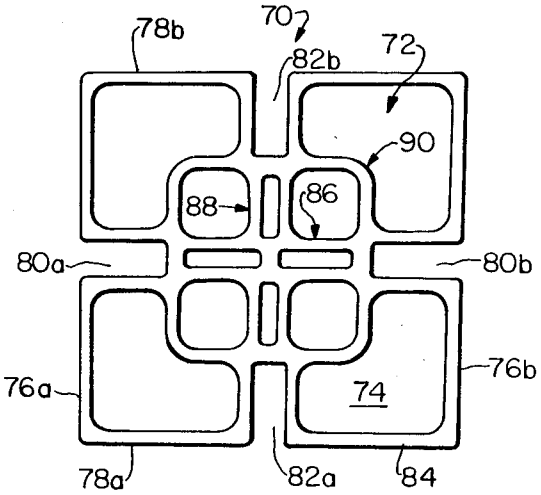
FIG. 6 is a bottom plan view of an alternative sized building element of the first embodiment.

Depicted in FIG. 6 is a building element 70 illustrating an element formed by only forming building element 10 with a single slot in each side. As shown, building element 70 has a square base 72 with a back face 74. Although building element 70 is square and thus symmetrical, building element 70 is described as having lateral sides 76*a* and 76*b* and longitudinal sides 78*a* and 78*b*. Similar to building element 10, building element 70 also includes longitudinal slots 80*a* and 80*b* and two lateral slots 82*a* and 82*b*. A peripheral flange 84 extends around the periphery of base 72 extending away from back face 74. Building element 70 further includes a longitudinal rib member 86, a lateral rib member 88, and right angle reinforcing ribs 90. As with building element 10, building element 70 is correspondingly sized and shaped insofar as the location, size, and length of slots 80*a*, 80*b*, 82*a*, and 82*b*, are concerned. In addition, the overall thickness of building element 70 at the outer edges of longitudinal sides 78*a* and 78*b*, peripheral flange 84, longitudinal rib member 86, lateral rib member 88, and right angle reinforcing ribs 90 is nominally equal to "W" as with building element 10.

In operation, the present invention is used to construct a play structure or the like by interconnecting similar shaped building elements, such as building elements 10 and 70. In order to interconnect building elements 10 and 70, base 11 is located perpendicular to base 72 with the longitudinal axis of one of slots 20*a*, 20*b*, 22*a*, 22*b*, 24*a*, 24*b*, 26*a*, 26*b*, 28*a*, or 28*b* coaxial with the longitudinal axis of one of slots 80*a*, 80*b*, 82*a*, or 82*b*. In this orientation, one of building elements 10 or 70 is moved along the axis of the respective slot such that the respective slots are received in one another and finally pass one another. When this occurs, such as for example when longitudinal slot 80*b* is received in longitudinal slot 20*a*, the portions of peripheral flange 84 on either side of longitudinal slot 80*b* rest against a rest area of longitudinal rib member 40 and the corresponding part of the front face 12 opposite that portion of rib member 40. Similarly, the portions of peripheral flange 30 along longitudinal slot 20*a* rest against a rest area of longitudinal rib member 86 and a portion of the front face of building element 70.

It should be appreciated that the making of longitudinal slot 80*b* and 20*a* with a width of "W" and the making of building elements 10 and 70 with a similar nominal thickness of "W" assures that there is a snug fit between buildings 10 and 70 when they are interconnected. However, although the slot width has been referred to as "W" it should also be appreciated that the thickness of the elements has been referred to as a "nominal" thickness of "W" because for two or more elements to slide together, the slot width could not be identical to the thickness of the elements. In addition, it should further be appreciated that with the length of longitudinal slot 20*a* equal to "d" and the locating of the adjacent edge of lateral slot 22*b* at a distance of "D" which is equal to twice "d", the innermost extent of lateral side 76*b* is parallel to the adjacent lateral edge of lateral slot 22*b*. Therefore, another building element can be received in lateral slot 22*b* without the corresponding side being interferred with by lateral side 76*b*. In other words, if desired, another building element such as 70 can be received in all of slots 20*a*, 20*b*, 22*a*, 22*b*, 24*a*, 24*b*, 26*a*, 26, 28*a*, and 28*b* of building element 10 at the same time without interference.

According to the preferred embodiment of the present invention, the thickness of building elements 10 and 70 is approximately 0.655 inches or 1.7 centimeters, the length of lateral sides is approximately 6.97 inches or 17.7 centimeters, and the overall length is 27.83 inches or 70.7 centimeters and 18.43 inches or 46.8 centimeters, respectively. In addition, other building elements with 3, 2, or no lateral slots would have overall length dimensions of 14.72 inches or 37.4 centimeters, 10.79 inches or 27.4 centimeters and 3.15 inches or 8.0 centimeters, respectively. With building elements of these sizes, toy structures such as stools, chairs, or the like which are large enough and strong enough to support the weight of a child can be constructed.

Figure 7:
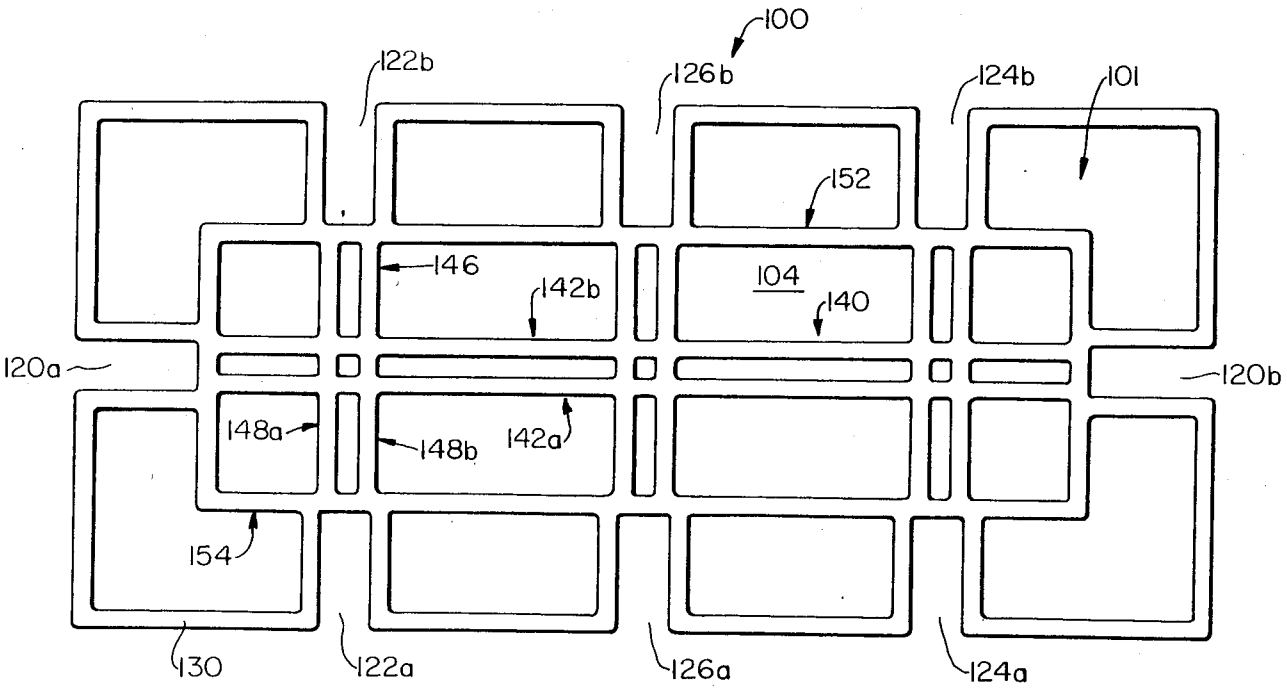
FIG. 7 is a bottom plan view of a second embodiment of a building element of the present invention.

Depicted in FIG. 7 is a second embodiment of a building element 100. Building element 100 includes a base 101 having a back face 104. Base 101 includes longitudinal slots 120*a* and 120*b*, lateral slots 122*a*, 122*b*, 124*a*, and 124*b*, and intermediate slots 126*a* and 126*b*. A peripheral flange 130 is also provided on base 101.

Base 101 also includes a longitudinal rib member 140 which includes two ribs, 142*a* and 142*b*. Meeting ribs 142*a* and 142*b* at right angles are lateral rib members 146 which are comprised of ribs 148*a* and 148*b*. Straight reinforcing ribs 152 and right angle reinforcing rib 154 are also provided.

It should be appreciated that building element 100 is broadly similar to building element 10, with the following exceptions. Whereas lateral rib members 46 in building element 10 are divided into two parallel ribs which are connected across longitudinal rib member 40, lateral rib members 146 of building element 100 includes parallel rib members 148*a* and 148*b* which are continuously connected across longitudinal rib member 140. Building element 100 also differs from building element 10 in that the various corners and different sections of the rib members are not reinforced by having different radii on the inside and outside corners. It is contemplated that building element 100 is made of a sufficiently strong material that this reinforcing is not needed. Building element 100 will also require less material to form than a correspondingly sized building element similar to building element 10 because there is no extra reinforcing.

Figure 8:
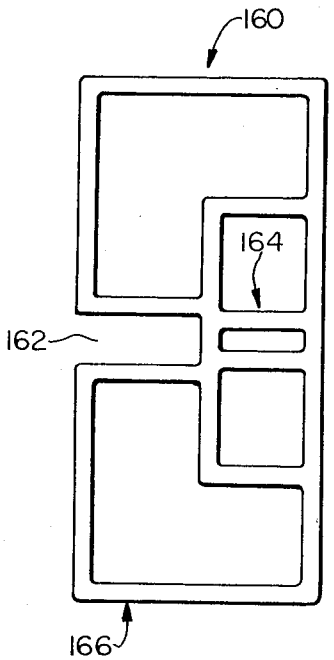
FIG. 8 is a bottom plan view of an alternative sized building element of the second embodiment.

Depicted in FIG. 8 is a building element 160 which is an alternative sized embodiment of the second embodiment of the present invention. Building element 160 is constructed similar to building element 100, but includes only a single longitudinal slot 162 and a short longitudinal rib member 164 extending between longitudinal slot 162 and a peripheral flange 166. Where building element 160 is used, it should be appreciated that no additional elements can be connected to building element 160. Instead, building element 160 merely provides a crosspiece mounted on a corresponding building element such as building element 100 which does not extend beyond the outer boundaries of the lateral or longitudinal slot in which slot 162 is received.

Building elements 100 and 160 are used in the same manner as building elements 10 and 70 and are preferably included in a set of differently sized building elements such as described above with respect to building elements 10 and 70.

It should also be appreciated that, as part of a building set of elements, building elements can be provided having one or more additional longitudinal slots in each lateral side so that greater sized structures can be more easily built. However, it is contemplated that the building set would include mostly building elements having only one longitudinal slot in each lateral side.

It should further be appreciated that a peripheral flange, longitudinal rib members, and lateral rib members could be provided on the front face of the building elements instead of the smooth and flat front face described above. In such a case, the width "W" would be measured from the outer edges of the flange on the front face.

While the present invention has been described with respect to exemplary embodiments thereof, it will be understood by those of ordinary skills in the art that variations and modifications can be effected within the scope and spirit of the invention.

I claim:

1. A building element for use in constructing a play structure with similarly shaped elements comprising:

a rectangular base having a longitudinal axis, a lateral axis, a thickness, a front face, a back face, two lateral sides parallel to the lateral axis, and two longitudinal side parallel to the longitudinal axis;

a rectangular longitudinal slot through said base opening outwardly in the center of each said lateral side, said rectangular longitudinal slots having a width "W" in a direction parallel to the lateral axis and extending inwardly perpendicularly from a respective lateral side and parallel to the longitudinal axis by a distance "d" equal to one-half of the lateral distance "D" from a respective said longitudinal side of said base to a respective said longitudinal slot;

a rectangular lateral slot opening outwardly along each said longitudinal side, lateral slots having a width equal to "W" in a direction parallel to the longitudinal axis and extending inwardly perpendicularly from a respective said longitudinal side and parallel to the lateral axis by the distance "d";

a peripheral flange extending perpendicularly from said back face around the peirphery of said back face and said slots, said peripheral flange having an outermost extending edge which is spaced from said front face by the nominal distance "W"; and a raised portion extending perpendicularly from said back face and including a plurality of planar rest areas parallel to said back face which are respectively spaced inwardly from a respective one of said longitudinal and lateral slots by a distance less than "d", said planar rest areas of said raised portions also being spaced from said front face by the nominal distance "W" whereby said building element is interlockable with a similarly shaped element perpendicular to said element as respective slots in each element are mutually received in one another; and wherein each said planar rest area of said raised portion of said longitudinal slots is a longitudinal rib member extending between said longitudinal slots and said longitudinal rib member includes a pair of closely spaced, parallel ribs extending between said longitudinal slots, said longitudinal rib member also serving to add rigidity to said building element.

2. A building element as claimed in claim 1 wherein said rectangular lateral slots are located at the distance "D" from a respective adjacent corner of said base to the adjacent edge of said respective lateral slot.

3. A building element as claimed in claim 2 and further including an additional lateral rectangular slot provided along each longitudinal side adjacent the other respective corner of said base.

4. A building element as claimed in claim 3 and further including at least one intermediate rectangular slot opening outwardly along each said longitudinal side and located at the distance "D" from a respective adjacent edge of an adjacent slot to the adjacent edge of said respective intermediate slot, said intermediate slots having a width equal to "W" and extending inwardly perpendicularly from a respective said longitudinal side by the distance "d".

5. A building element as claimed in claim 1 wherein each said planar rest area of said raised portion for said lateral slots is a lateral rib member extending between opposed lateral slots, said lateral rib member also serving to add rigidity to said building element.

6. A building element as claimed in claim 5 wherein said longitudinal rib member and said lateral rib member are integrally formed with each other and said peripheral flange, and wherein said lateral rib member includes a pair of closely spaced parallel ribs.

7. A building element as claimed in claim 6 wherein said building element is integrally formed of a foamed polyethylene.

8. A building element as claimed in claim 5 wherein the corners of said peripheral flange have a greater thickness than the rest of said peripheral flange whereby the corners of said peripheral flange are reinforced.

9. A building element as claimed in claim 2 wherein the corners of said peripheral flange have a greater thickness than the rest of said peripheral flange wherein the corners of said peripheral flange are reinforced.

10. A building element as claimed in claim 5 and including reinforcing ribs which extend from a portion of said peripheral flange adjacent one said slot to a portion of said peripheral flange adjacent an adjacent said slot.

11. A building element as claimed in claim 10 wherein said reinforcing ribs, said peripheral flange, said lateral rib members, and said longitudinal rib member are integrally formed with said base.

12. A building element as claimed in claim 11 wherein said portion of said peripheral flange from which respective said reinforcing ribs extend is an inside corner of a respective said slot.

13. A building element as claimed in claim 2 wherein said front face of said base is substantially smooth and flat.

14. A building element as claimed in claim 5 wherein said front face of said base is substantially smooth and flat.

15. A building element for use in constructing a play structure with similarly shaped elements comprising:

a rectangular base having a longitudinal axis, a lateral axis, a thickness, a front face, a back face, two lateral sides parallel to the lateral axis, and two lontitudinal sides parallel to the longitudinal axis;

at least one slot through said base opening outwardly in the respective center of at least one of said sides, said rectangular slot having a width "W" in a direction parallel to the lateral axis and extending inwardly perpendicularly from the respective side and parallel to the longitudinal axis by a distance "d" equal to one-half of the distance "D" from a respective said longitudinal side of said base to the adjacent said slot;

a peripheral flange extending perpendicularly from said back face around the periphery of said back face and said slot, said peripheral flange having an outermost extending edge which is spaced from said front face by the distance "W"; and a rib member which extends from the inner end of said slot toward the opposite side, said rib member extending perpendicularly to said side having said slot and extending perpendicularly from said back face to have an outer edge which is spaced from said front face by the distance "W" whereby said building element is interlockable with a similarly shaped element perpendicular to said building element as respective slots on each element are mutually received in one another; and wherein said rib member includes a pair of closely spaced parallel ribs.

16. A building element as claimed in claim 15 wherein the corners of said peripheral flange have a greater thickness than the rest of said peripheral flange whereby the corners of said peripheral flange are reinforced.

17. A building element for use in constructing a play structure with similarly shaped elements comprising:

a rectangular base having longitudinal axis, a lateral axis, a thickness, a front face, a back face, two lateral sides parallel to the lateral axis, and two longitudinal sides parallel to the longitudinal axis;

at least one rectangular longitudinal slot through said base opening outwardly in each said lateral side, said rectangular longitudinal slots having a width "W" in a direction parallel to the lateral axis and extending inwardly perpendicularly from a respective lateral side and parallel to the longitudinal axis by a distance "d" equal to one-half of the lateral distance "D" from a respective said longitudingal side of said base to an adjacent said longitudinal slot;

a least one rectangular lateral slot opening outwardly along each said longitudinal side, said lateral slots having a width equal to "W" in a direction parallel to the longitudinal axis and extending inwardly perpendicularly from a respective said longitudinal side and parallel to the lateral axis by the distance "d";

a raised portion extending perpendicularly from said back face around the periphery of said back face and said slots, said peripheral flange having an outermost extending edge which is spaced from said front face by the distance "W"; and a peripheral flange extending perpendicularly from said back face and including a plurality of planar rest areas parallel to said back face which are respectively spaced inwardly from a respective one of said lonigitudinal and lateral slots by a distance less than "d", said planar rest areas of said raised portions also being spaced from said front face by the distance "W" whereby said building element is interlockable with a similarly shaped element perpendicular to said element as respective slots in each element are mutually received in one another; and wherein each said planar rest area of said raised portion for said longitudinal slots is a longitudinal rib member extending between said longitudinal slots and said longitudinal rib member includes a pair of closely spaced, parallel ribs extending between said longitudinal slots, said longitudinal rib member also serving to add rigidity to said building element.

* * * * *